US009566535B2

(12) United States Patent
Crorey

(10) Patent No.: US 9,566,535 B2
(45) Date of Patent: Feb. 14, 2017

(54) DEVICE AND KIT FOR MAKING KNOTTED LANYARD ACCESSORIES

(71) Applicant: David J. Crorey, Clinton Township, MI (US)

(72) Inventor: David J. Crorey, Clinton Township, MI (US)

( * ) Notice: Subject to any disclaimer, the term of this patent is extended or adjusted under 35 U.S.C. 154(b) by 113 days.

(21) Appl. No.: 14/614,593

(22) Filed: Feb. 5, 2015

(65) Prior Publication Data

US 2015/0152579 A1 Jun. 4, 2015

Related U.S. Application Data

(63) Continuation-in-part of application No. 13/783,755, filed on Mar. 4, 2013, now Pat. No. 9,091,003.

(51) Int. Cl.

| | |
|---|---|
| ***A63H 33/30*** | (2006.01) |
| ***D04G 5/00*** | (2006.01) |
| ***B65H 69/04*** | (2006.01) |
| ***D04D 9/06*** | (2006.01) |

(52) U.S. Cl.

CPC ..... *A63H 33/3088* (2013.01); *B65H 69/04* (2013.01); *D04D 9/06* (2013.01); *D04G 5/00* (2013.01)

(58) Field of Classification Search

CPC ..... D04G 5/00; D04D 9/06; A63H 33/3088; B65H 69/04

See application file for complete search history.

(56) References Cited

U.S. PATENT DOCUMENTS

| | | | |
|---|---|---|---|
| 758,376 | A | 4/1904 | Mees |
| 1,203,781 | A | 11/1916 | Ratycia |
| 2,043,082 | A | 6/1936 | Wallach |
| 2,072,668 | A | 3/1937 | Eltgroth |
| 2,123,077 | A | 7/1938 | Mayer |
| 2,129,297 | A | 9/1938 | Zippel |
| D134,208 | S | 10/1942 | McCrary |
| D142,530 | S | 10/1945 | Rosenblatt |

(Continued)

FOREIGN PATENT DOCUMENTS

| | | | |
|---|---|---|---|
| JP | 01256315 | A | 10/1989 |
| WO | 2006053909 | A1 | 5/2006 |

OTHER PUBLICATIONS

Notification of Transmittal, International Search Report and Written Opinion dated Aug. 19, 2010 from International Application No. PCT/US2010/021101.

*Primary Examiner* — Shaun R Hurley

(74) *Attorney, Agent, or Firm* — Young Basile Hanlon & MacFarlane, P.C.

(57) ABSTRACT

A device for making knotted string accessories from a plurality of individual strings has a base having a substantially planar surface and a central longitudinal axis, a plurality of string holders connected to and extending away from the substantially planar surface of the base, the plurality of string holders symmetric with respect to the central longitudinal axis and configured to retain one of plurality of individual strings between adjacent string holders and a securing member carried by the base and positioned along the central longitudinal axis. The securing member secures at least one string of the plurality of individual strings. An electronic device holder is carried by the base and is configured to hold an electronic device to be viewed by a user making a knotted string accessory.

12 Claims, 12 Drawing Sheets

(56) References Cited

U.S. PATENT DOCUMENTS

| | | | | |
|---|---|---|---|---|
| 2,395,981 | A | 3/1946 | Walker | |
| 2,601,222 | A | 6/1952 | Wehrli | |
| 2,624,957 | A | 1/1953 | Collins | |
| D204,442 | S | 4/1966 | Brawley, Jr. | |
| 3,545,069 | A | 12/1970 | Krieger | |
| 3,650,010 | A | 3/1972 | Powell, Jr. | |
| 3,700,272 | A | 10/1972 | Bauer | |
| 3,708,862 | A | 1/1973 | Powell, Jr. | |
| 3,800,372 | A | 4/1974 | Daoust | |
| D238,812 | S | 2/1976 | Fioretti | |
| 4,045,061 | A | 8/1977 | Fierro | |
| 4,103,944 | A | 8/1978 | Alvarado et al. | |
| D257,257 | S | 10/1980 | McArthur | |
| 4,260,185 | A | 4/1981 | Shiplee, III | |
| 4,401,329 | A | 8/1983 | Pedroia | |
| 6,119,854 | A | 9/2000 | Prentice et al. | |
| 6,719,013 | B1 | 4/2004 | D'Estais | |
| 6,910,748 | B1 | 6/2005 | Fountain | |
| 7,147,008 | B2 | 12/2006 | Sayler | |
| D563,997 | S | 3/2008 | Gustin | |
| D619,150 | S | 7/2010 | Crorey | |
| D626,574 | S | 11/2010 | Crorey | |
| 7,946,631 | B2 | 5/2011 | Crorey | |
| D656,524 | S | 3/2012 | Karwowicz | |
| 8,172,281 | B2 | 5/2012 | Crorey | |
| D667,468 | S | 9/2012 | Crorey | |
| 2006/0169608 | A1 | 8/2006 | Carnevali | |
| 2009/0090833 | A1* | 4/2009 | Daraz | B60R 11/0241 248/316.7 |
| 2010/0218840 | A1 | 9/2010 | Crorey | |
| 2013/0285375 | A1* | 10/2013 | Crorey | D04G 5/00 289/2 |
| 2014/0069973 | A1* | 3/2014 | Peck | B60R 11/02 224/411 |
| 2014/0162733 | A1* | 6/2014 | Cole | G06F 1/1607 455/575.1 |

* cited by examiner

DEVICE AND KIT FOR MAKING KNOTTED LANYARD ACCESSORIES

CROSS-REFERENCE TO RELATED APPLICATION

This application is a continuation-in-part of U.S. patent application Ser. No. 13/783,755 filed on Mar. 4, 2013, incorporated herein by reference in its entirety.

TECHNICAL FIELD

The embodiments herein relate in general to hand crafted accessories and to devices to assist in the making of knotted string jewelry and accessories.

BACKGROUND

A popular craft project involves making accessories such as bracelets and necklaces by knotting colorful string or plastic. The practice involves many strands of string knotted in a particular pattern to produce the desired product. The process is made easier by keeping the strings separated and somewhat stationary to keep track of the pattern as the product is made. This requires dexterity and can require an uninterrupted time and place in which to craft. Knotted string bracelets have become very popular with adolescents and teens to wear and give to friends. The craft is often done with others, with any minor distraction making it difficult to keep track of the pattern and maintain the strings in the correct positions. In an effort to better manage the strings while crafting, it has been known to use tape to secure the string to a table or the like. A device for providing a simple management system would simplify the craft and make it more enjoyable, particularly for the younger crafters.

BRIEF SUMMARY

Disclosed herein are embodiments of devices for making knotted string accessories from a plurality of individual strings, the embodiments including an electronic device holder to hold an electronic device for viewing by a user, the electronic device contemplated to provide instructions to the user.

An embodiment of a device for making knotted string accessories from a plurality of individual strings comprises a base having a substantially planar surface and a central longitudinal axis, a plurality of string holders connected to and extending away from the substantially planar surface of the base, the plurality of string holders symmetric with respect to the central longitudinal axis and configured to retain one of plurality of individual strings between adjacent string holders, a securing member carried by the base and positioned along the central longitudinal axis, the securing member configured to secure at least one string of the plurality of individual strings and an electronic device holder carried by the base and configured to hold an electronic device to be viewed by a user making a knotted string accessory.

Other embodiments are described in more detail in the detailed description herein.

BRIEF DESCRIPTION OF THE DRAWINGS

The description herein makes reference to the accompanying drawings wherein like reference numerals refer to like parts throughout the several views, and wherein.

DETAILED DESCRIPTION OF THE EMBODIMENTS

Figure 1:
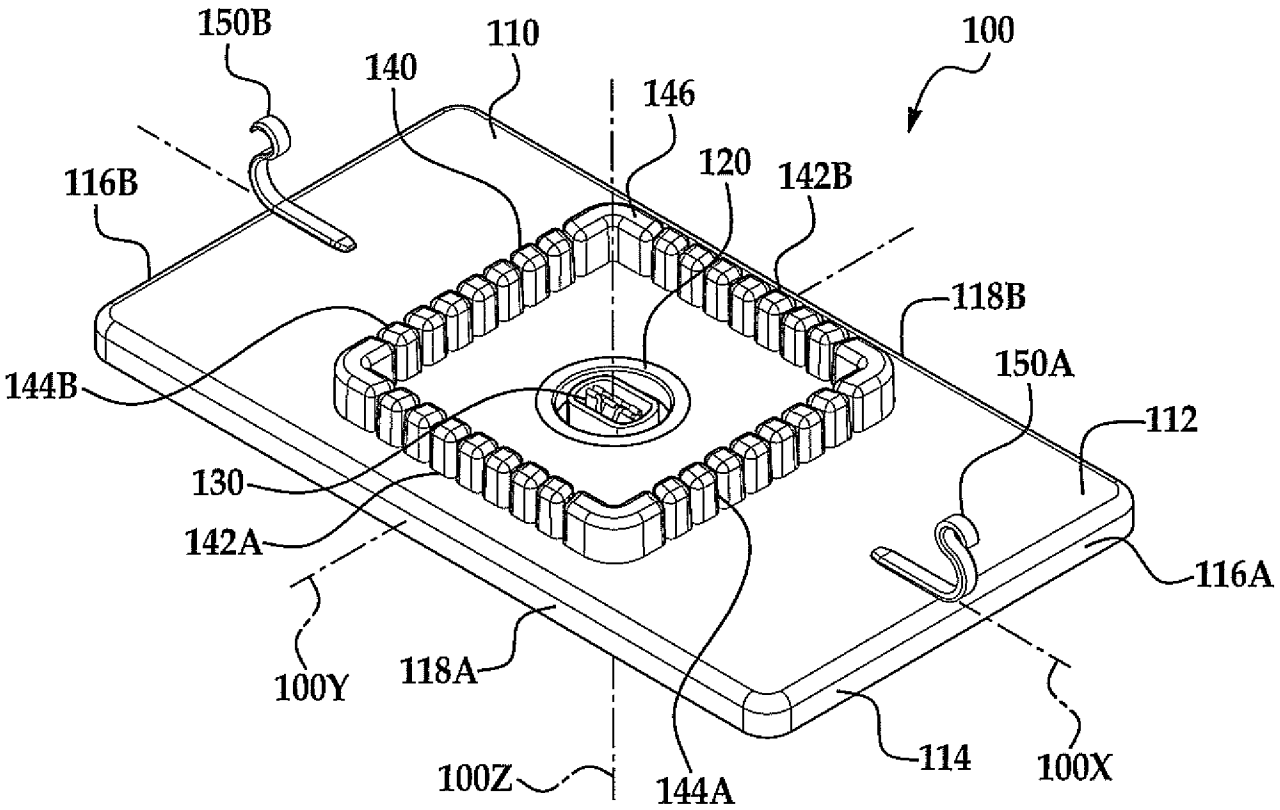
FIG. 1 is a perspective view of an embodiment of a device for making knotted string accessories as disclosed herein.

FIG. 1 is a perspective view of an embodiment of a device for making knotted string accessories as disclosed herein. The device 100 for making knotted string accessories from a plurality of individual strings may include a base 110 which may have a substantially planar surface 112, a perimeter 114, a first end 116A, a second end 116B opposite the first end 116A, a first side 118A, and a second side 118B opposite the first side 118A. The base 110 may have a longitudinal axis 100X, a latitudinal axis 100Y, and a center axis 100Z that extends perpendicular to the substantially planar surface 112. Although the base 110 is illustrated as rectangular, the base 110 may be any shape desired or required, such as square, circular, or oval.

The device 100 may include a center aperture 120 through which the center axis 100Z extends. The center aperture 120 may extend through the base 110, and may be positioned, for example, at the intersection of the longitudinal axis 100X, the latitudinal axis 100Y, and the center axis 100Z. In some embodiments, other positions for the center aperture 120 may be used. For example, the center aperture 120 may be positioned proximate to the first end 116A. Although the aperture 120 is illustrated as round, the aperture 120 may be any shape desired or required.

The device 100 may include a securing member 130, such as a clip, configured to secure a plurality of individual strings. For example, the securing member 130 may be configured to secure a portion, such as a central portion, of each of the plurality of individual strings. The securing member 130 may be carried by or connected to the substantially planar surface 112 of the base 110, and may be positioned proximate to the center axis 100Z. In some embodiments with a center aperture, the securing member 130 may be positioned within the center aperture 120. The securing member 130 can by any device capable of retaining the plurality of individual strings so that the strings may be used by a crafter. For example, the securing member can simply be a bar extending across the aperture 120 around which the strings can be tied.

The device 100 may include a plurality of holders 140, which may be configured to retain strings. In some embodiments, the plurality of holders 140 may be connected to and may extend away from the substantially planar surface 112 of the base 110. The plurality of holders 140 may include a first plurality of longitudinal holders 142A which may be positioned proximate to the first side 118A, a second plurality of longitudinal holders 142B which may be positioned proximate to the second side 118B, a first plurality of latitudinal holders 144A which may be positioned proximate to the first end 116A, and a second plurality of latitudinal holders 144B which may be positioned proximate to the second end 116B. In some embodiments, the plurality of holders 140 may include a plurality of corner holders 146, each of which may be positioned proximate to one of the first end 116A or the second end 116B and one of the first side 118A or the second side 118B. The individual holders 140 are illustrated as being square in shape. However, the individual holders 140 can be any shape as desired or required so long as adjacent holders can retain an individual string. The plurality of holders 140 may be made of foam, plastic, or other similar material. The plurality of holders 140 may be foam strips with slits separating the individual holders.

Although a plurality of longitudinal holders are illustrated and shown forming a square, the longitudinal holders may be a single continuous longitudinal holder in any shape desired or required, such as a circle. The plurality of longitudinal holders may alternatively be arranged in any other shape known, such as a diamond, rectangle, and the like.

The device 100 may optionally include a first hook 150A, which may be positioned proximate to first end 116A and a second hook 150B, which may be positioned proximate to the second end 116B. The first hook 150A and the second hook 150B may be removably connected to the device 100.

As used herein, "substantially planar surface" means having a two-dimensional characteristic able to position the plurality of holders 140 as required for making the string accessories. The term does not limit the surface to being smooth, as the surface may be textured if desired or required.

The term "strings" as used herein includes any elongated material that can be used with the devices disclosed herein to make bracelets, necklaces, lanyards, belts, and the like. "String" can include embroidery string, thread, yarn, plastic strips for making lanyards, elastic material, and any other material known to those skilled in the art. String can be one or more colors, one or more texture, and one or more material. String can be silk, cotton, plastic, rayon, etc.

The term "holder" as used herein means a member that is used with an adjacent member to retain an individual string.

The term "knotted" as used herein means any interaction between at least two individual strings that contributes to the pattern of the accessory being made. Other common terms are weaving, tying, braiding, and the like. The methods described below are provided by way of example and are not meant to be limiting. The movement of the strings and order in which they are taken up may be different depending on the pattern being made.

Figure 2:
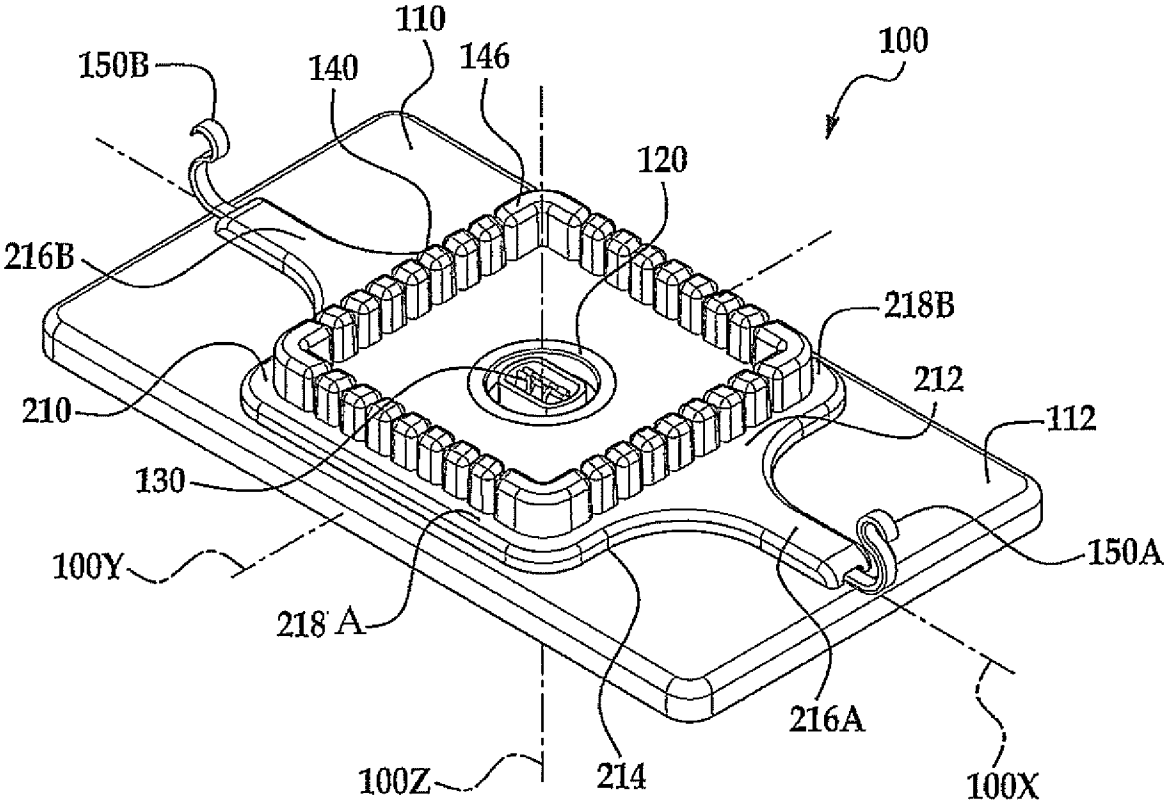
FIG. 2 is a perspective view of an embodiment of a device for making knotted string accessories including a holder platform as disclosed herein.

FIG. 2 is a perspective view of the device 100 including a holder platform as disclosed herein. In some embodiments, the device 100 may include a holder platform 210, which may have a substantially planar surface 212, a perimeter 214, a first end 216A, a second end 216B opposite the first end 216A, a first side 218A, and a second side 218B opposite the first side. The holder platform 210 may be connected to the substantially planar surface 112 of the base 110, and may be positioned, for example, at the intersection of the longitudinal axis 100X, the latitudinal axis 100Y, and the center axis 100Z.

The center axis 100Z may extend perpendicular to the substantially planar surface of the holder platform 210. The center aperture 120 may extend through the holder platform 210. The securing member 130 may be carried by or connected to the holder platform 210. Some or all of the plurality of holders 140 may be connected to and may extend away from the substantially planar surface 212 of the holder platform 210. The first hook 150A and the second hook 150B may be removably connected to the device 100 between the base 110 and the holder platform 210.

Figure 3:
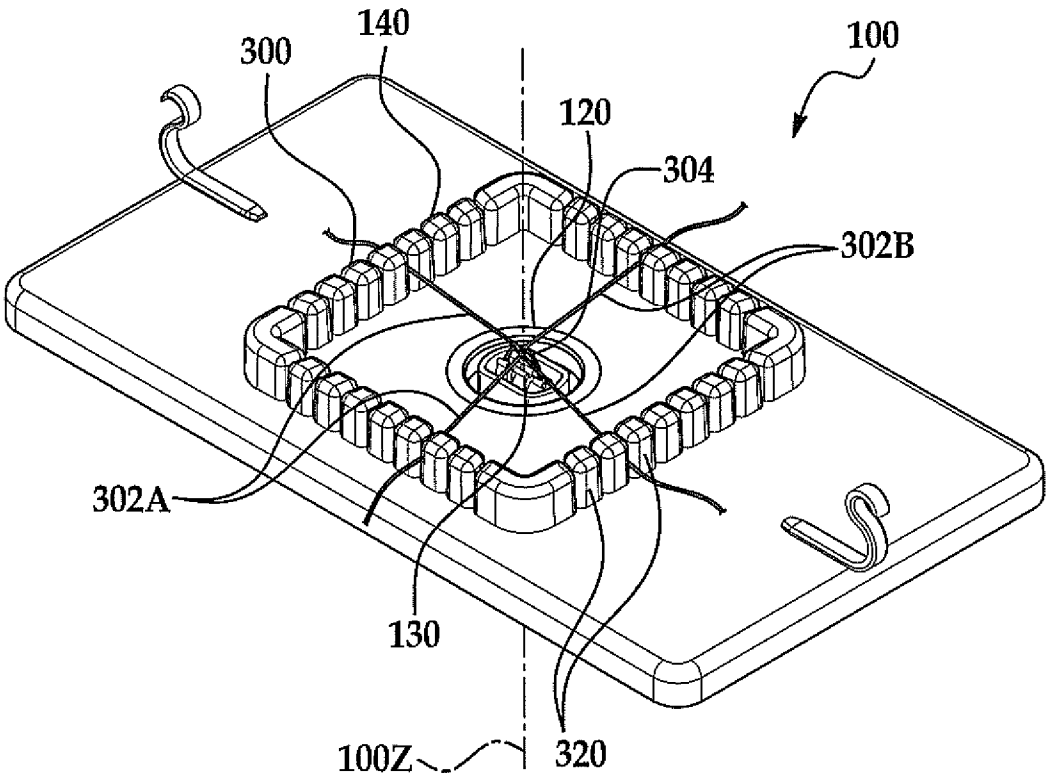
FIG. 3 is a perspective view of a device for making knotted string accessories showing placement of a plurality of individual strings used with the device to make knotted string accessories as disclosed herein.

FIG. 3 is a perspective view of the device 100 showing placement of a plurality of individual strings 300 used with the device 100 to make knotted string accessories as disclosed herein. Each string may include a first end portion 302A, a second end portion 302B opposite the first end portion 302A, and a central portion 304 between the first end portion 302A and the second end portion 302B. In some embodiments, the central portion 304 of the plurality of strings may be positioned near the center axis 100Z. For example, a mounting device, such as the securing member 130 shown in FIG. 1, may retain the central portion 304 of the plurality of strings 300. In some embodiments, the central portion 304 of the strings may be fixedly attached to a secondary securing element, such as a key ring or hook, and the secondary securing element may be retained by the securing member 130.

The first end portion 302A, the second end portion 302B, or both, may be positioned in and retained by the plurality of holders 140. The plurality of holders 140 may be configured to retain individual strings, and can be a variety of forms. Non-limiting examples can include clips, holes, knobs, raised portions, and slits. The holders 140 can be made of plastic, rubber, foam, or any other material known to those skilled in the art.

As shown, the plurality of holders 140 includes a plurality of separated or raised portions 320 positioned in close proximity to one another. Although 32 raised portions 320 are shown, any number of raised portions can be used. Each individual string of the plurality of strings 300 can be retained between adjacent raised portions 320 of the plurality of holders 140 such that the strings are sufficiently taut. Although, two individual strings are shown in FIG. 3, any number of strings can be used as desired or required based on individual preference or the requirements of a pattern.

In some embodiments, the plurality of raised portions 320 may include a retainer mechanism between adjacent raised portions 320 configured to retain the individual strings. For example, the raised portions may comprise an elastic material and the retaining mechanism may be the compressive force between adjacent raised portions 320. In some embodiments, the retaining mechanism can be, for example, a slit made in one of the adjacent raised portions 320. The individual string can be placed in the slit and tightly gripped by the surrounding raised portion. Pieces of elastic material can be placed between the adjacent raised portions to elastically compress the string. Adjacent raised portions can be coated with an elastic material like rubber to hold the strings there between. The central portion 304 of the plurality of strings 300 can be held substantially stationary near the center axis 100Z by the tension on the individual strings held in the plurality of holders 140.

Figure 4:
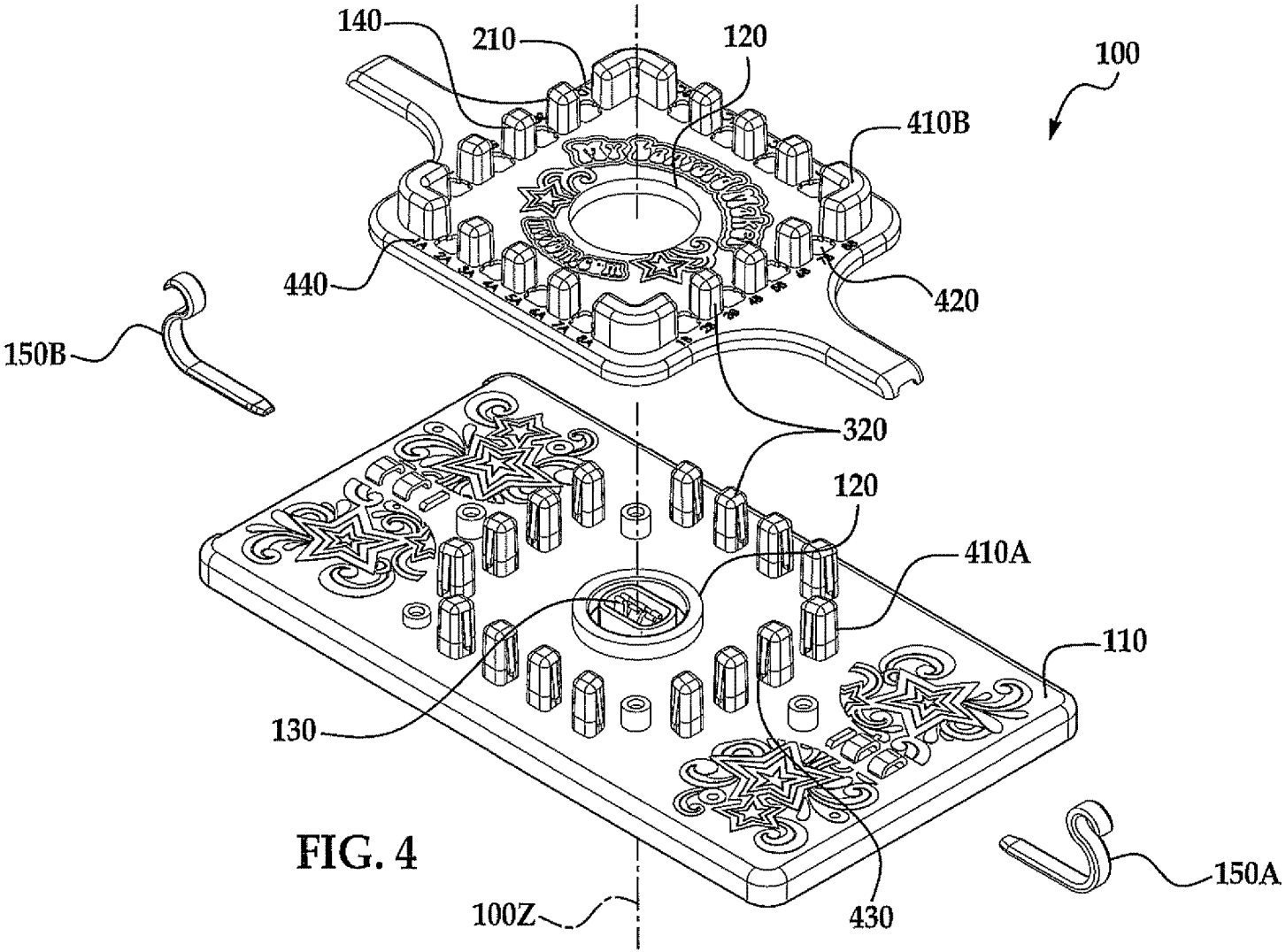
FIG. 4 shows an expanded perspective view of an embodiment of a device for making knotted string accessories including the holder platform as disclosed herein.

FIG. 4 shows an expanded perspective view of an embodiment of the device 100 including the holder platform 210 as disclosed herein. In this embodiment, a first subset 410A of the plurality of holders 140 may be connected to the base 110 such that every other raised portion may be provided by the base 110 and a second subset 410B of the plurality of holders 140 may be connected to the holder platform 210 such that alternate raised portions may be provided by the holder platform 210. In this embodiment, the holder platform 210 may include a plurality of holder apertures 420 positioned between raised portions, through which the raised portions provided by the base 110 may extend. Side springs 430 can be integrally formed on opposing sides of each of the raised portions provided by the base 110. The side springs 430 may expand toward the raised portions provided by the holder platform 210, thereby creating a retainer mechanism between adjacent raised portions configured to retain the individual string.

In some embodiments, the base 110, the holder platform 210, or both, may include indicia 440 on the substantially planar surface 112/212 located near the plurality of holders 140. The indicia 440 may include numerals, letters, symbols, or any other form that would help a user in orientating the device 100. For example, the indicia 440 can comprise numbers in series and equal to the number of raised portions 320. In another example, the indicia 440 may include a first set of indicia, such as numbers, proximate to the plurality of holders 140 and a second set of indicia (not shown), such as letters, proximate to and positioned equidistantly around the center axis 100z. The indicia can alternatively be placed directly on the holders.

To make a knotted string accessory, a pattern, an amount of string, and a color of string desired or required for the pattern may be selected. The strings may be aligned and a central portion 304 of the plurality of strings 300 may be secured by the securing member 130. The end portions 302A/302B of individual strings may be placed in the plurality of holders 140 in accordance with the pattern. Individual strings may be moved from positions in the plurality of holders 140 such that the movement of the strings produces knots in the plurality of strings 300 until the accessory formed by the knotting of the strings is the desired length.

Figure 5:
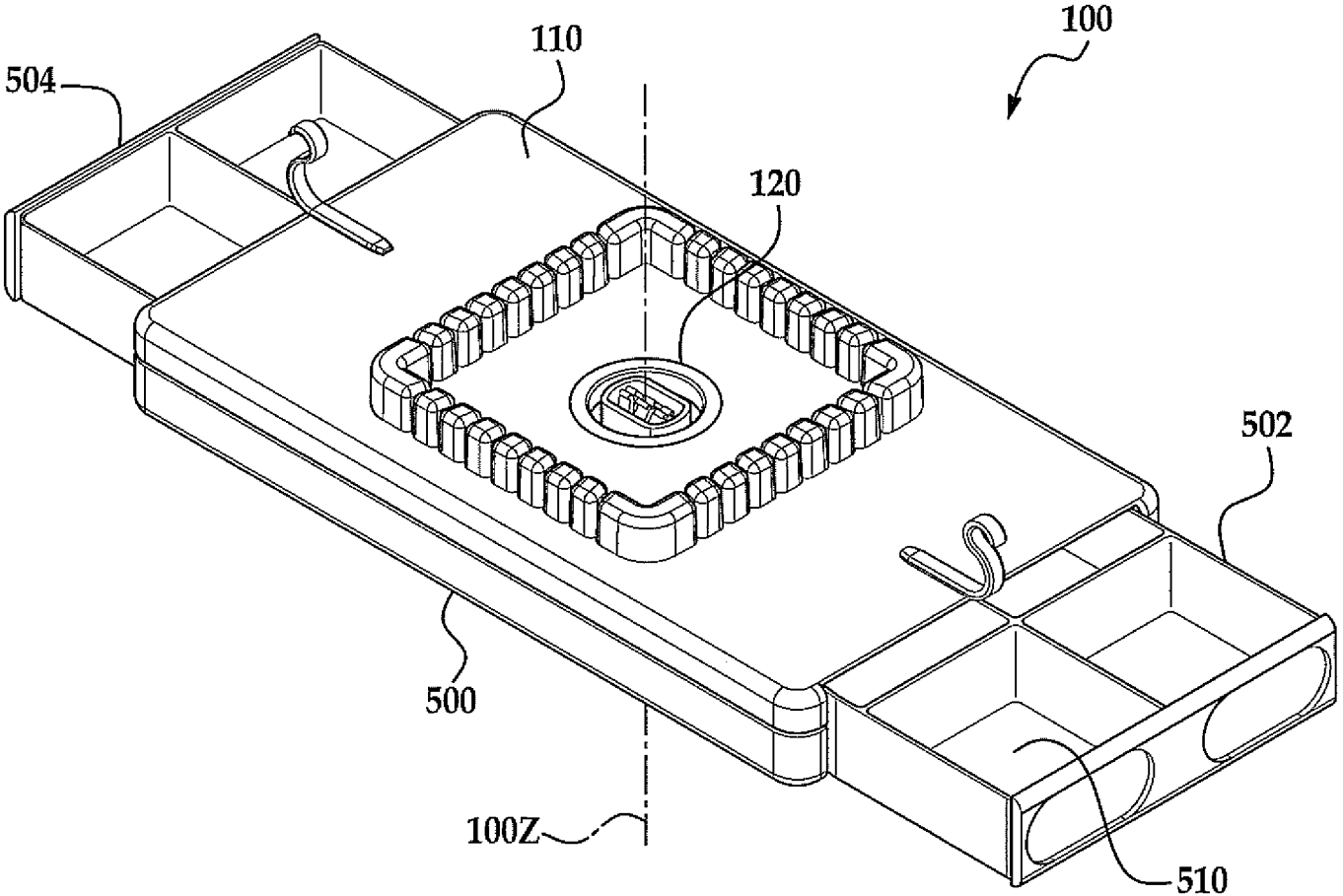
FIG. 5 shows a perspective view of an embodiment of a device for making knotted string accessories including a storage unit as disclosed herein.

FIG. 5 shows a perspective view of an embodiment of device 100 including a storage unit 500 as disclosed herein. The storage unit 500 may include a plurality of storage compartments 502/504 and may be connected to the base 110. Each storage compartment 502/504 may have one or more inner cavities 510. Although one configuration of inner cavities 510 is shown in FIG. 5, the inner cavities can be any shape or configuration desired or required. The storage compartments 502/504 may be configured to store anything that is sized to be retained in the inner cavities 510. For example, strings, beads, gems, instructions, or the like may be stored in the inner cavities 510. The storage compartments 502/504 may be slidably attached to the storage unit 500, as shown, with the storage compartments 502/504 in a partially open position. One or more of the inner cavities can be exposed when the storage compartments 502/504 are in an open or partially open position, allowing communication with the exposed inner cavities to retrieve or store items.

Although two storage compartments 502/504 are shown, any number of storage compartments may be used. For example, the device 100 may include a single storage compartment. The storage compartments 502/504 can releasably engage the storage unit 500. For example, the storage compartments 502/504 can be slidably attached to the storage unit 500 so that they are moveable between an open position and a closed position. In some embodiments, the center aperture 120 may extend through the storage unit 500. The storage compartments can be attached to the base at the perimeter with a hinge, such that the base pivots opened and closed. It is also contemplated that the base may have portions that open and close, providing access to the storage compartments.

Figure 6:
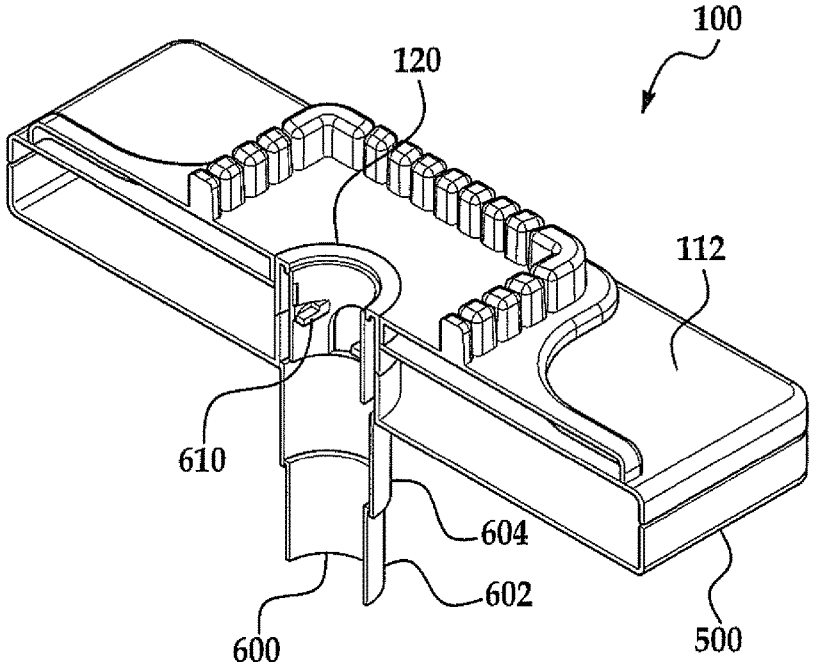
FIG. 6 shows a sectional perspective view of an embodiment of a device for making knotted string accessories including a telescoping aperture collar and a securing member mount as disclosed herein.

FIG. 6 is a sectional perspective view of an embodiment of the device 100 including a telescoping aperture collar 600 and a securing member mount 610 as disclosed herein. The telescoping aperture collar 600 and the securing member mount 610 may be positioned in and extend through the center aperture 120. The telescoping aperture collar 600 may slidably attached to the base 110, the holder platform 210, the storage unit 500, or any combination thereof. The telescoping aperture collar 600 may include plurality of telescoping portions 602/604 configured to fit one within another. Although two telescoping portions 602/604 are shown, any number of telescoping portions may be used. Each telescoping portion 602/604 of the telescoping aperture collar 600 may have a length that is less than or equal to a distance from the substantially planar surface 112 of the base 110 to a lower outer surface of the storage unit 500, and a diameter that is less than a diameter of the center aperture 120.

The securing member mount 610 may be configured to releasably connect with the securing member 130 (not shown) and to releasably connect with the base 110, the holder platform 210, or both. In some embodiments, the securing member mount 610 may have a diameter that is smaller than the telescoping aperture collar 600.

Figure 7A:
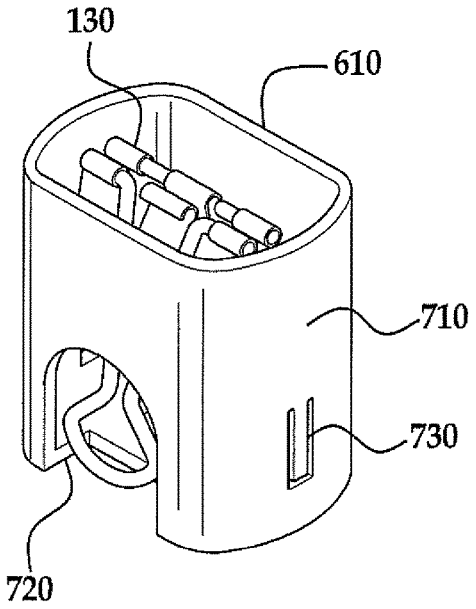
FIG. 7A shows a perspective view of an embodiment of a securing member mount as disclosed herein.

FIG. 7A shows a perspective view of an embodiment of the securing member mount 610 as disclosed herein. The securing member mount 610 may include a securing member housing 710 and a securing member retaining unit 720 configured to releasably connect with the securing member housing 710 and to fixedly retain the securing member 130 within the securing member housing 710. The securing member housing 710 may include side springs 760, which may be integrally formed on opposing sides of the securing member housing 710. The side springs 730 may expand toward the securing member retaining unit 720 to provide sufficient tension to retain the securing member retaining unit 720 within the securing member housing 710.

Figure 7B:
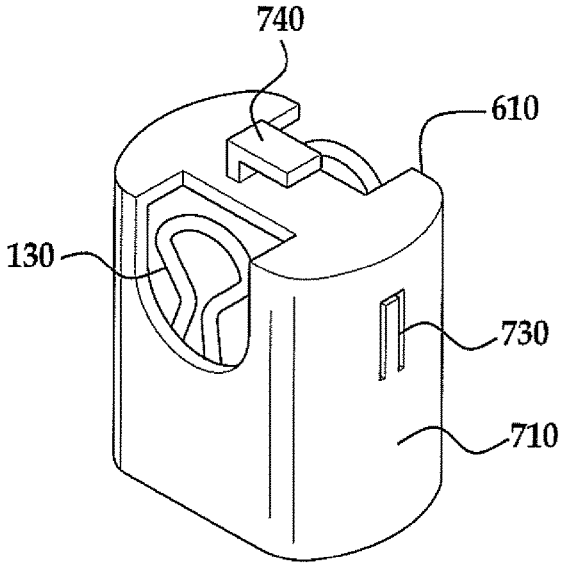
FIG. 7B shows another perspective view of an embodiment of a securing member mount as disclosed herein.

FIG. 7B shows another perspective view of an embodiment of the securing member mount 610 as disclosed herein. In some embodiments, the securing member mount 610 may be configured to selectably attach to the device 100 in a first configuration, wherein the securing member 130 is positioned proximate to the substantially planar surface 112/212, or a second configuration, wherein securing member retaining unit 720 is positioned proximate to the substantially planar surface 112/212. The securing member retaining unit 720 may include an integrated securing member 740, such as a hook or clip, configured to retain the plurality of individual strings in the absence of, or in addition to the securing member 130.

Figure 8:
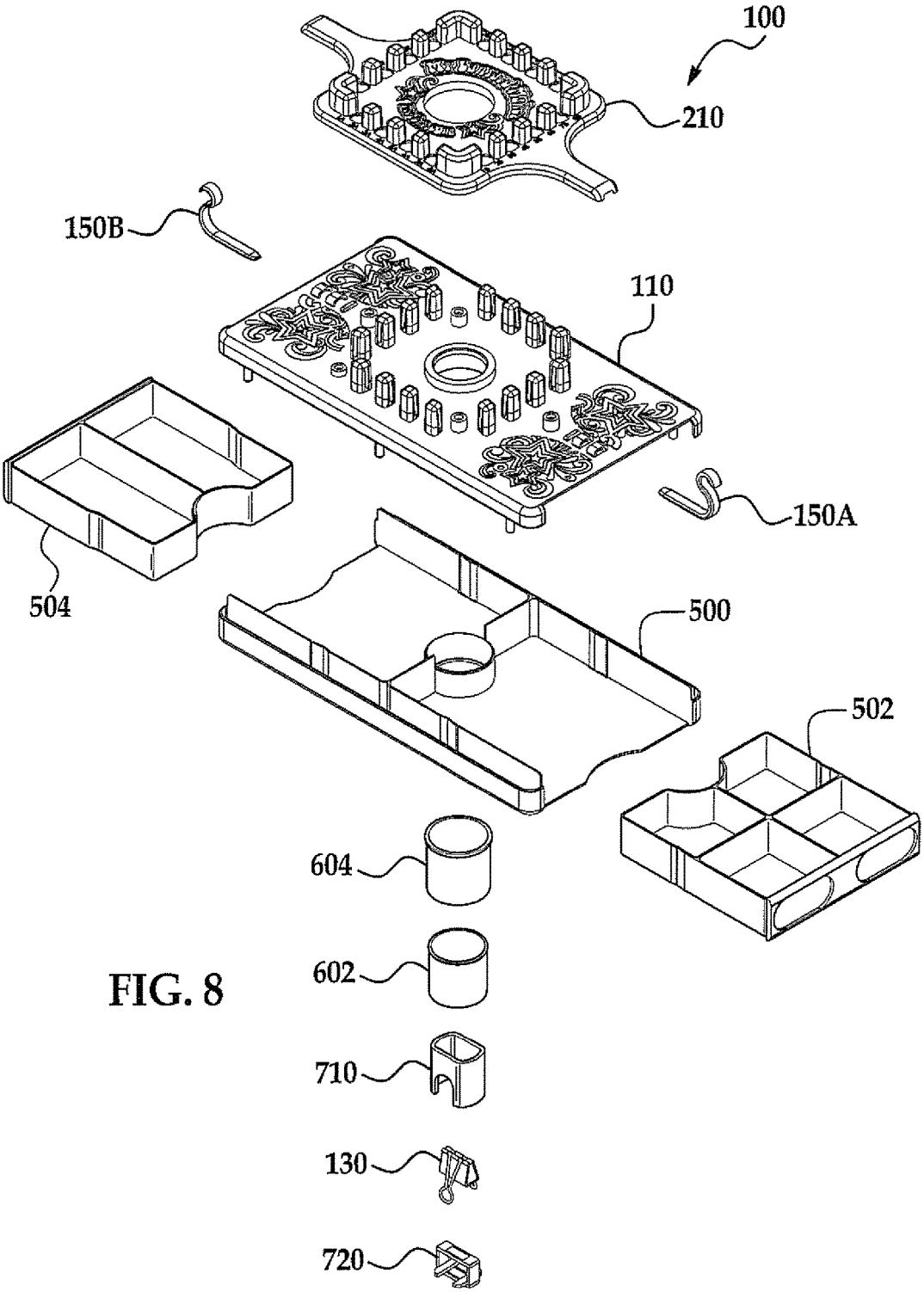
FIG. 8 shows an expanded perspective view of an embodiment of a device for making knotted string accessories as disclosed herein.

FIG. 8 is an exploded perspective view of an embodiment of the device 100 as disclosed herein. As shown, the device 100 may include the base 110, the holder platform 210, the hooks 150A/150B, the storage unit 500, the storage compartments 502/504, the telescoping portions 602/604, the securing member housing 710, the securing member 130, the securing member retaining unit 720, or any combination thereof.

Figure 9:
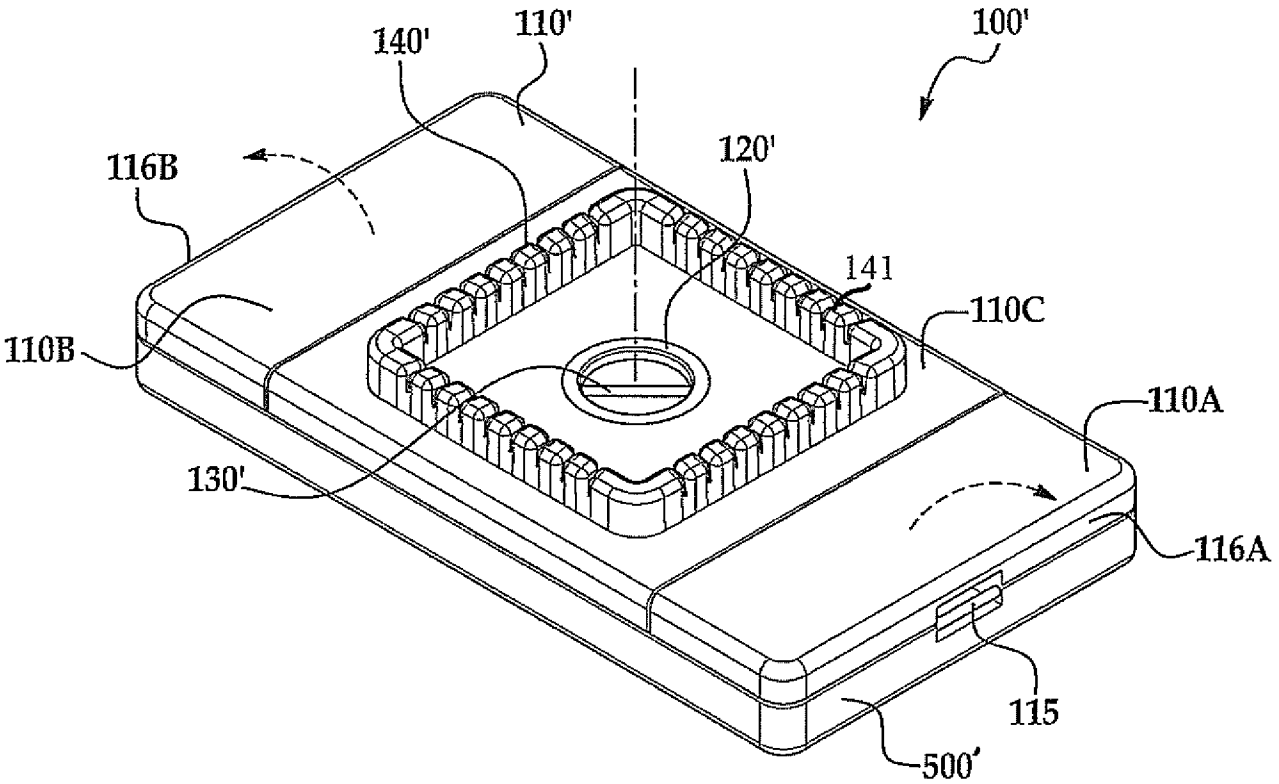
FIG. 9 is a perspective view of another embodiment of a device for making knotted string accessories as disclosed herein.

FIG. 9 is a perspective view of another embodiment of a device 100' for making knotted string accessories from a plurality of individual strings. The device includes a base 110', a center aperture 120' through which a center axis extends, and a securing member 130'. The securing member 130' is a bar or rod extending across the aperture 120', either below the aperture 120', within the aperture 130', or on top of the aperture 120'. The device 100' also includes one or more holders 140', here shown made of foam with slits 141 formed within the foam in which to retain an individual string.

The base 110' can be formed in sections 110A, 110B and 110C. As shown, 110A and 110B are movable with respect to the section 110C via a hinge 115 on each end 116A and 116B of the base 110' to allow access to a storage compartment 500' underneath.

FIGS. 10-13 illustrate the devices described above fitted with an electronic device holder. The device 10, 10', 10" for making knotted string accessories from a plurality of individual strings may include the base 110 which may have a substantially planar surface 112. Although the base 110 is illustrated as rectangular, the base 110 may be any shape desired or required, such as square, circular, or oval. The base 110 has a central longitudinal axis A.

The device 10, 10', 10" will include a plurality of holders 140, which may be configured to retain strings. In some embodiments, the plurality of holders 140 may be connected to and may extend away from the substantially planar surface 112 of the base 110. The plurality of holders 140 may be formed in a linear fashion, forming one or more lines in one or more shapes. For example, in FIGS. 10-12, the plurality of holders 140 forms a square. As another example, in FIGS. 13A and 13B, the plurality of holders 140 is in the shape of an arc. However, the individual holders 140 can be any shape as desired or required so long as adjacent holders can retain an individual string. The plurality of holders 140 may be made of foam, plastic, or other similar material. The plurality of holders 140 may be foam strips with slits separating the individual holders. The plurality of holders 140 can be symmetrical with respect to the central longitudinal axis A.

The device 10, 10" may include a center aperture 120. The center aperture 120 may extend through the base 110, and may be positioned, for example, in the center of the square of the plurality of holders 140. Although the aperture 120 is illustrated as round, the aperture 120 may be any shape desired or required. The center aperture 120 can by symmetrical with respect to the central longitudinal axis A.

Figure 12:
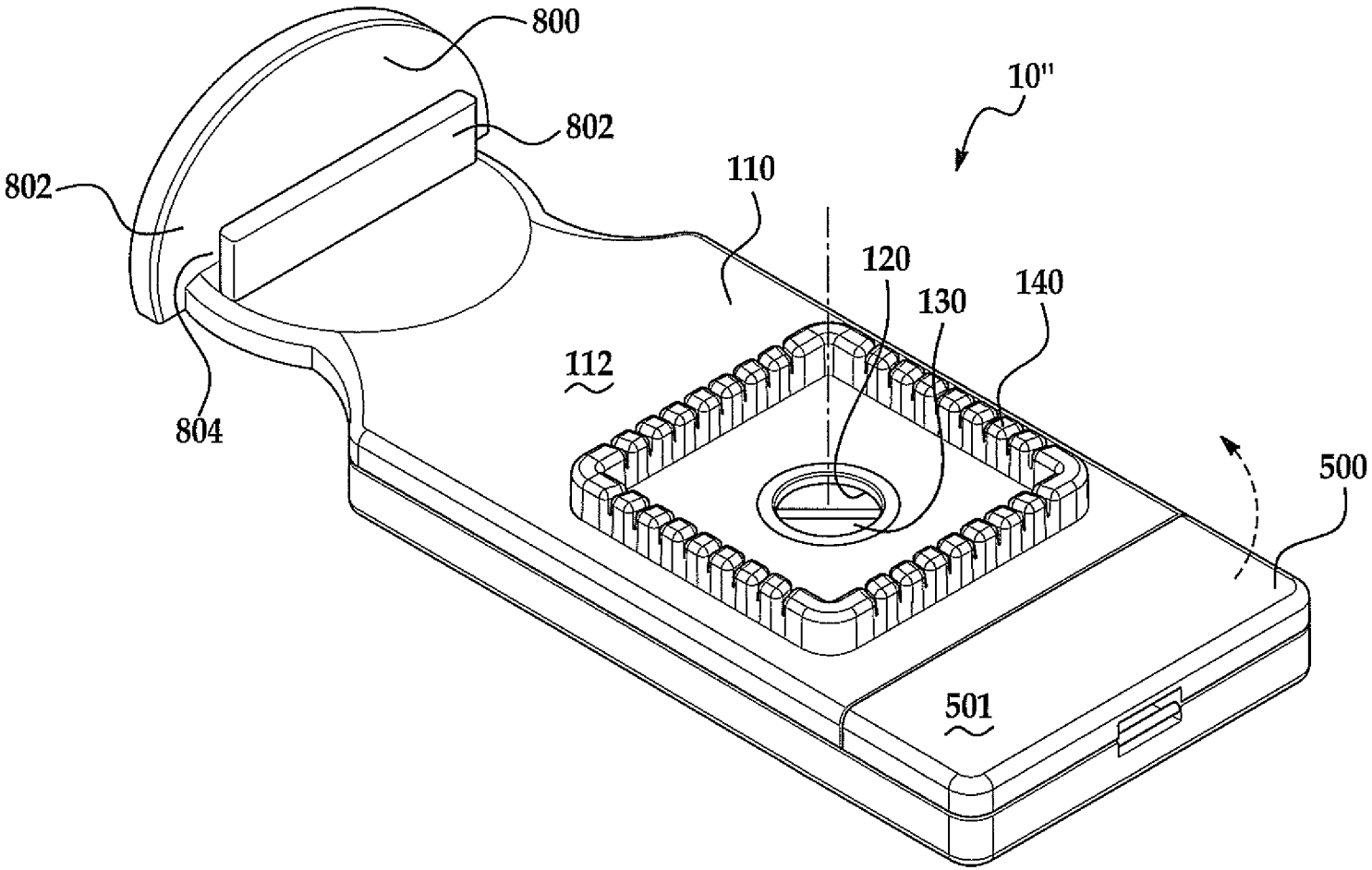
FIG. 12 is a perspective view of another embodiment of a device for making knotted string accessories having an electronic device holder as disclosed herein.

The device 10, 10', 10" may include a securing member 130, such as a hook or a clip, configured to secure a plurality of individual strings. For example, the securing member 130 may be configured to secure a portion, such as a central portion, of each of the plurality of individual strings. The securing member 130 may be carried by or connected to the substantially planar surface 112 of the base 110, and may be positioned proximate to the center axis 100Z. In some embodiments with a center aperture, the securing member 130 may be positioned within the center aperture 120. The securing member 130 can by any device capable of retaining the plurality of individual strings so that the strings may be used by a crafter. For example, the securing member can simply be a bar extending across the aperture 120 around which the strings can be tied, as illustrated in FIG. 12. The securing member 130 can be positioned along the central longitudinal axis A.

Any of the devices 10, 10', 10" can include one or more storage compartments. FIG. 12 shows a perspective view of device 10" including a storage unit 500 as disclosed herein. The storage unit 500 may include a plurality of cavities and may be connected to the base 110 in any manner. The storage unit 500 may be configured to store anything that is sized to be retained in the inner cavities. For example, strings, beads, gems, instructions, or the like may be stored in the inner cavities. The storage unit 500 may be slidably attached to the base 110 or may have a door 501 attached to the base 110 and movable between an open and closed position, as shown in FIG. 12.

The device 10, 10', 10" may include an electronic device holder 800 carried by the base 110 and configured to hold an electronic device (shown in FIG. 11) such as a mobile phone or tablet. The electronic device can display instructional pictures, text or videos for the user of the device 10, 10', 10", explaining how to position each of the plurality of strings to obtain a particular pattern, also illustrated in FIG. 11. An app or a website can provide the instructional pictures, text or videos for the user to use. The electronic device holder 800 is shown at one end of the device 10, 10" but can be positioned anywhere accessible to the user to view when using the device 10, 10".

Figure 10:
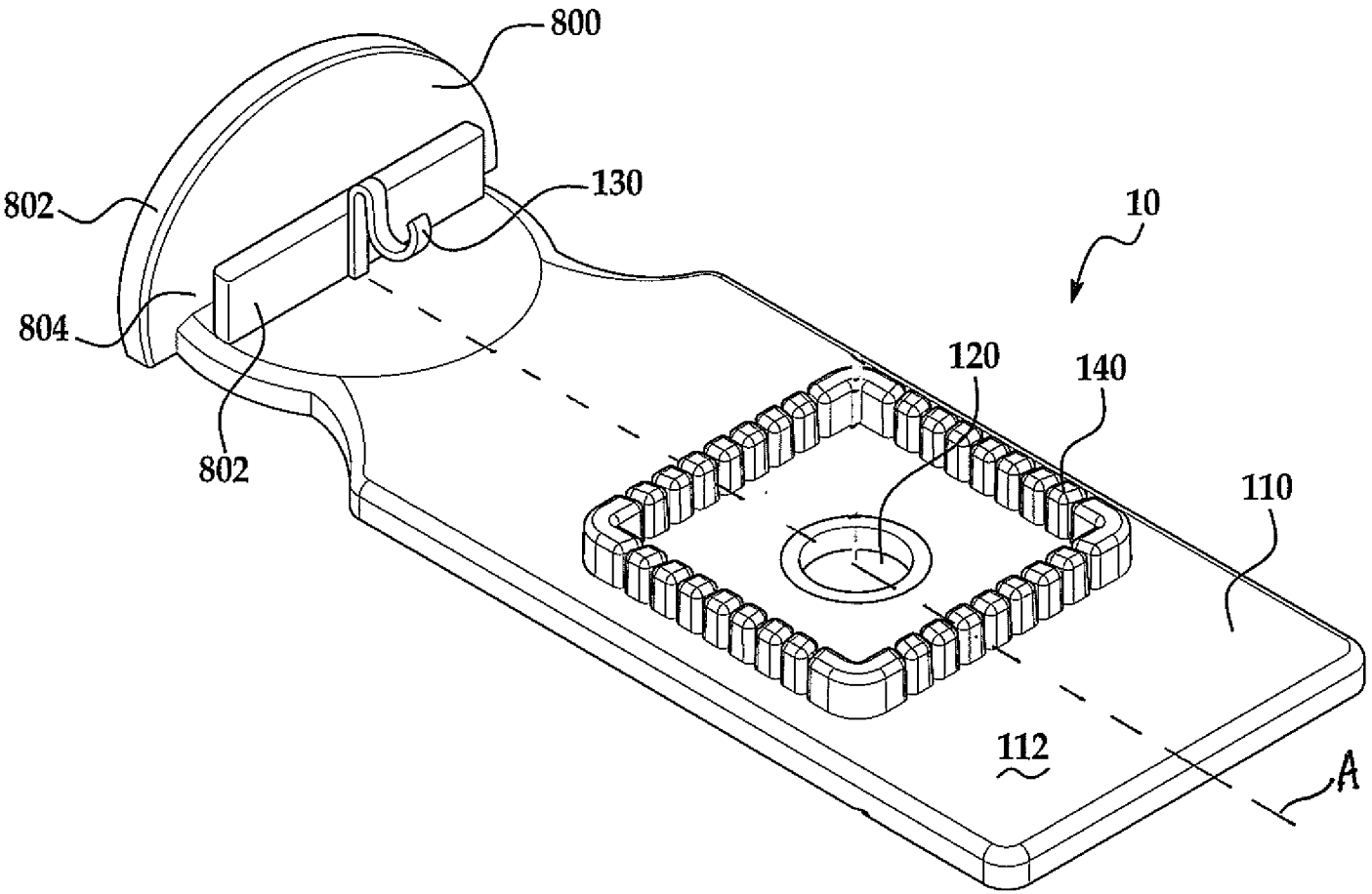
FIG. 10 is a perspective view of an embodiment of a device for making knotted string accessories having an electronic device holder as disclosed herein.
Figure 11:
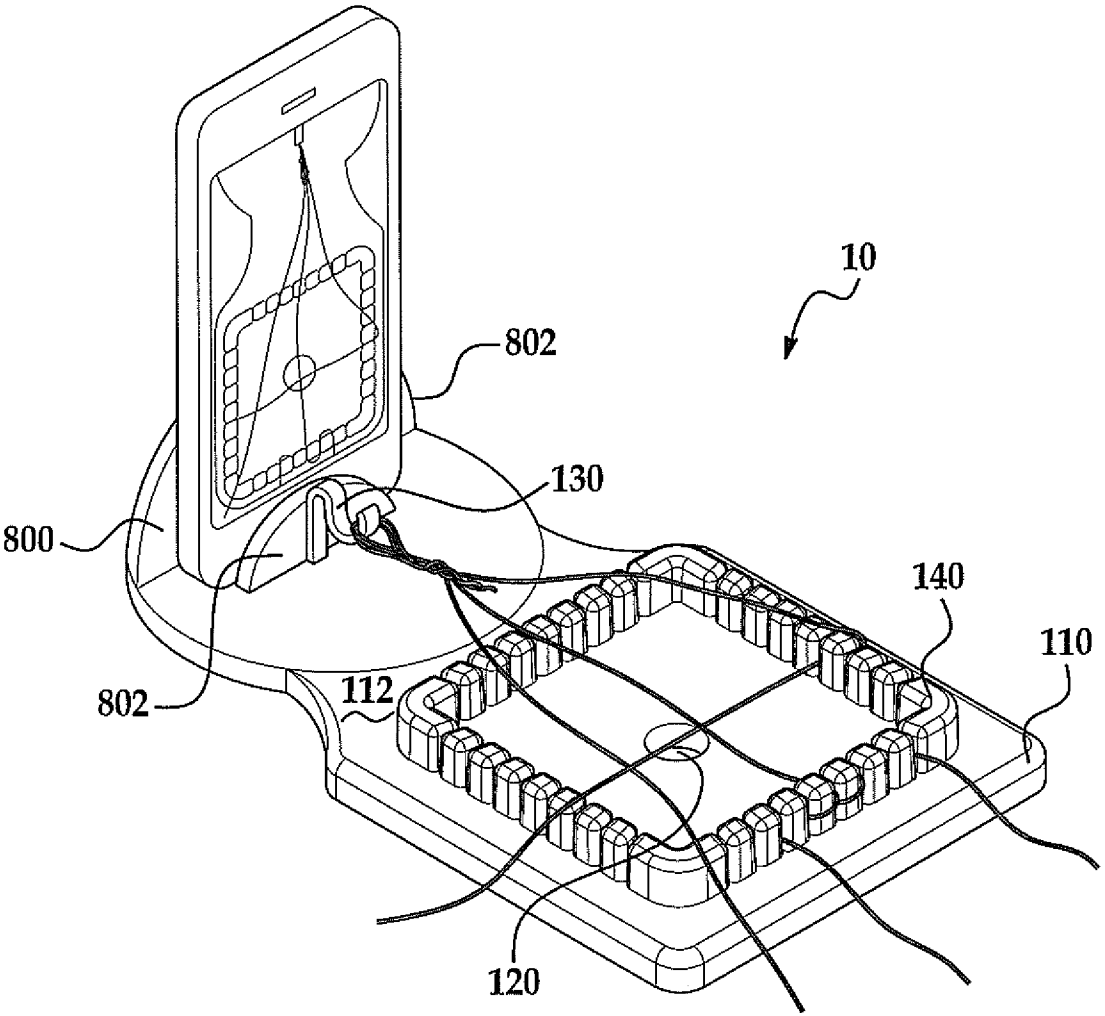
FIG. 11 is the perspective view of the device of FIG. 10 holding an electronic device.

The device 10, 10" can have a stationary electronic device holder 800, such as shown in FIGS. 10-12. The electronic device holder 800 can have at least two support walls 802 spaced apart, providing a recess 804 such that the electronic device can be slid between the at least two support walls and maintained in a vertical or nearly vertical position in the recess 804. The walls 802 can be of any shape and size desired. The walls 802 do not have to be solid, but can resemble a fence if desired. The electronic device holder 800 can have a wall 802 on each side, totaling four walls if desired. One of the walls 802 is shown smaller than the other to provide as much viewing screen of the electronic device as possible.

Figure 13A:
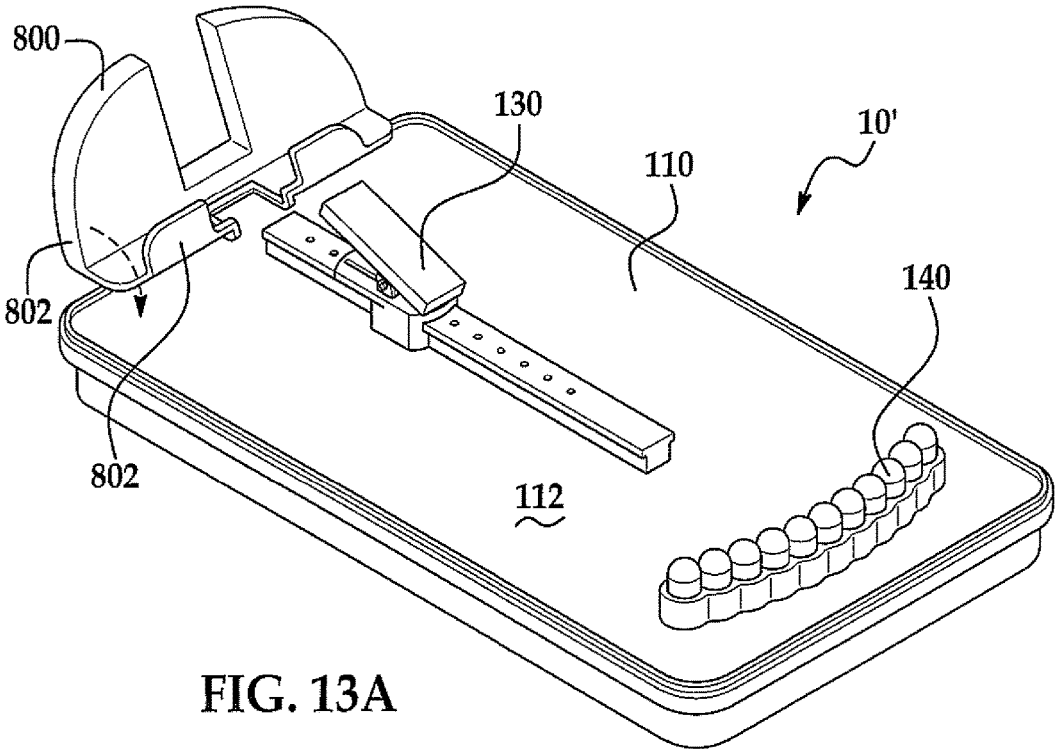
FIG. 13A is a perspective view of another embodiment of a device for making knotted string accessories having a movable electronic device holder in the open holding position as disclosed herein.
Figure 13B:
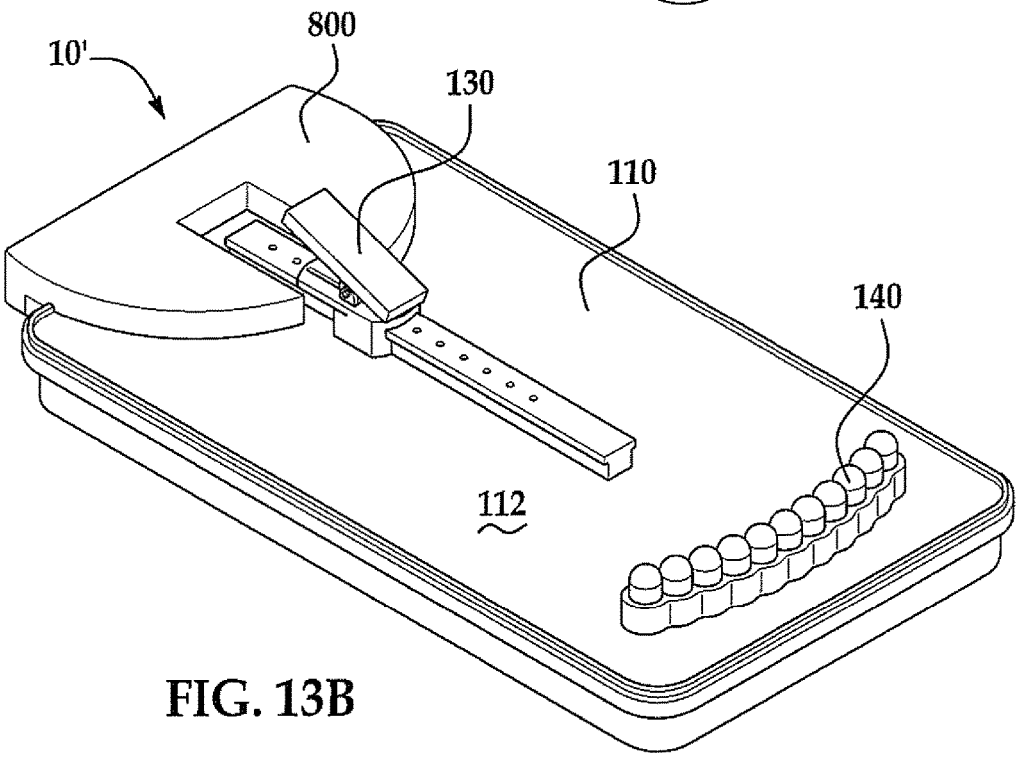
FIG. 13B is the embodiment of the device of FIG. 13A with the electronic device holder in the closed position as disclosed herein.

The electronic device holder 800 can also be movable so that it can be stored when the device 10' is stored, as illustrated in FIGS. 13A and 13B. In FIG. 13A, the electronic device holder 800 is illustrated in the open position, ready to receive an electronic device. In FIG. 13B, the electronic device holder 800 is shown in the closed, or stored, position. The support walls 802 move together into the closed position.

The elements in the embodiments disclosed herein can be combined in any manner to form a device as contemplated herein.

Embodiments of the device disclosed herein can be made from plastic, foam, rubber, metal, resin and combinations thereof. Any material known to those skilled in the art that will provide the strength and rigidity necessary to function as desired or required can be used. Elements of the device can be molded individually and assembled or more than one element of the device can be molded together to reduce the number of parts for assembly.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A device for making knotted string accessories from a plurality of individual strings, the device comprising:

a base having a substantially planar surface and a central longitudinal axis;

a plurality of string holders connected to and extending away from the substantially planar surface of the base, the plurality of string holders symmetric with respect to the central longitudinal axis and configured to retain one of plurality of individual strings between adjacent string holders;

a securing member carried by the base and positioned along the central longitudinal axis, the securing member configured to secure at least one string of the plurality of individual strings; and an electronic device holder carried by the base and configured to hold an electronic device to be viewed by a user making a knotted string accessory, wherein the electronic device holder is movable between an open position configured to receive the electronic device and a closed position configured to have a low profile and the electronic device holder has a cutout configured to align with the securing member when the electronic device holder is in the closed position.

2. The device of claim 1, wherein the securing member is positioned between the electronic device holder and the plurality of string holders.

3. A device for making knotted string accessories from a plurality of individual strings, the device comprising:

a base having a substantially planar surface and a central longitudinal axis;

a plurality of string holders connected to and extending away from the substantially planar surface of the base, the plurality of string holders symmetric with respect to the central longitudinal axis and configured to retain one of plurality of individual strings between adjacent string holders;

a securing member carried by the base and positioned along the central longitudinal axis, the securing member configured to secure at least one string of the plurality of individual strings; and an electronic device holder carried by the base and configured to hold an electronic device to be viewed by a user making a knotted string accessory, wherein the electronic device holder comprises at least two walls extending from the base and spaced to provide a recess configured to receive the electronic device and the securing member contacts one of the at least two walls of the electronic device holder.

4. The device of claim 1, wherein the electronic device holder comprises spaced apart walls forming a recess in which the electronic device can be received.

5. The device of claim 1, wherein the base has an aperture extending therethrough and the plurality of string holders are positioned to surround the aperture.

6. The device of claim 5, wherein the securing member is positioned in the aperture.

7. The device of claim 1, wherein the electronic device holder is positioned at one end of the base and plurality of string holders are positioned proximate an opposite end of the base.

8. The device of claim 1, wherein the plurality of string holders are positioned in an arc.

9. The device of claim 1, further comprising a storage compartment in the base, the storage compartment having an inner cavity.

10. The device of claim 9, wherein the storage compartment has a door attached to the base and movable between an open position and a closed position.

11. The device of claim 1, wherein the plurality of string holders are made of foam with adjacent string holders separated by a slit configured to retain at least one of the plurality of individual strings.

12. A device for making knotted string accessories from a plurality of individual strings, the device comprising:

a base having a substantially planar surface and a central longitudinal axis;

a plurality of string holders connected to and extending away from the substantially planar surface of the base, the plurality of string holders symmetric with respect to the central longitudinal axis and configured to retain one of plurality of individual strings between adjacent string holders;

a securing member carried by the base along the central longitudinal axis, the securing member having a movable portion and a fixed portion, the movable portion configured to secure at least one string of the plurality of individual strings at a plurality of locations along the fixed portion; and an electronic device holder carried by the base and configured to hold an electronic device to be viewed by a user making a knotted string accessory, wherein the electronic device holder is movable between an open position configured to receive the electronic device and a closed position configured to have a low profile, the electronic device holder having a cutout configured to receive a part of the securing member when the electronic device holder is in the closed position.

* * * * *